US006296047B1

(12) United States Patent
Benedetti

(10) Patent No.: US 6,296,047 B1
(45) **Date of Patent: *Oct. 2, 2001**

(54) ENDLESS CASTING ROLLING SYSTEM WITH SINGLE CASTING STAND

(75) Inventor: Gianpietro Benedetti, Campoformido-Udine (IT)

(73) Assignee: Danieli Technology, Inc., Cranberry Township, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/315,844

(22) Filed: May 21, 1999

(51) Int. Cl.[7] ..... B21D 11/00

(52) U.S. Cl. ..... 164/476; 164/477; 164/417

(58) Field of Search ..... 164/476, 477, 164/417

(56) References Cited

U.S. PATENT DOCUMENTS

| | | | | |
|---|---|---|---|---|
| 5,490,315 | | 2/1996 | Kostopolos et al. | 29/527.7 |
| 5,765,626 | | 6/1998 | Yamada . | |
| 5,810,069 | * | 9/1998 | Flick et al. | 164/476 |

FOREIGN PATENT DOCUMENTS

| | | | |
|---|---|---|---|
| 0 761 327 A1 | | 3/1997 | (EP) . |
| 0 860 215 A1 | | 8/1998 | (EP) . |
| 0 867 239 A2 | | 9/1998 | (EP) . |
| 57206502 | | 12/1982 | (JP) . |
| 58173005 | | 10/1983 | (JP) . |
| 60033804 | | 2/1985 | (JP) . |
| WO 98/56517 | * | 12/1998 | (WO) . |

OTHER PUBLICATIONS

Cone, c: "Reheating Furnace for Continuous Steelmaking", Iron and Steel Engineer, US, Pittsburgh, vol. 9, No. 44, Sep. 1967.*

Verderevskii V. A. et al. "Casting–Rolling Unit For Producing Wire Rod", *Steel in Translation*, GB, The Institute Of Materials, London, vol. 25, No. 12, pp. 37–41, 1995, XP 000630468.

M. Lestani "New Concepts in the Production of Speciality Steels in Bars and Coils", *La Revue de Metallurgie* —CIT, Oct. 1, 1997, pp. 1225–1236, XP–000734342.

European Search Report dated Dec. 20, 1999 and Annex.

U.S. Patent application Ser. No. 09/315,843 filed May 21, 1999.

U.S. Patent application Ser. No. 09/315,845 filed May 21, 1999.

U.S. Patent application Ser. No. 09/315,848 filed May 21, 1999.

U.S. Patent application Ser. No. 09/315,847 filed May 21, 1999.

U.S. Patent application Ser. No. 09/315,846 filed May 21, 1999.

* cited by examiner

*Primary Examiner*—Tom Dunn
*Assistant Examiner*—Jonathan Johnson
(74) *Attorney, Agent, or Firm*—Armstrong, Westerman, Hattori, McLeland & Naughton, LLP

(57) ABSTRACT

An integrated plant for the production of elongated metal products, such as bars and rods, is described in which the product is initially cast in continuous caster equipment and conducted toward a rolling mill which is positioned in-line with the continuous caster equipment. A tunnel furnace is disposed between the continuous caster equipment and the rolling mill for heating, equalizing and/or holding the product at a predetermined rolling temperature and a descaling assembly operates to descale the product prior to delivery to the rolling mill.

7 Claims, 1 Drawing Sheet

ENDLESS CASTING ROLLING SYSTEM WITH SINGLE CASTING STAND

The present invention relates to an integrated plant for the production of elongated metal products, such as bars and rods, and the like. More particularly, the invention involves an integrated plant in which an elongated metal product is produced in a continuous caster and is thereafter directly operated on in a rolling mill apparatus disposed in-line with the caster in a substantially continuous sequence.

BACKGROUND OF THE INVENTION

It has commonly been the practice to separate the caster and the rolling mill in order to enable product, which has been prepared by a variety of preliminary processing procedures, to be preliminarily processed and thereafter introduced to the rolling line. More recently, since the development of "hot charging" processes, it is known to provide transport means and storage devices for handling cut to length billets or blooms and to introduce them while hot to a heating furnace. While this practice saves and reduces the need for billet storage, it suffers the drawbacks of reduced material output due to the need for cropping the cast product into short lengths, the presence of short bars in the bed, and the generation of scale in the furnace.

Although several of these defects have been overcome by the method for the continuous casting of long products as described in European Patent Application No. EP 0 761 327 to Meroni, et al. and assigned to the assignee hereof, the disclosed method suffers from its own drawbacks that an induction furnace is used before the rolling process to increase the billet surface temperature and then enable its equalization in an air section. This concept is no longer applied in the present invention, according to which the furnace is used to guarantee the stay time after the equalization. Furthermore, in the present invention there is the possibility of having a longer heating time and thus a softer heating curve. This reduces the thermal stress on the material and improves both its quality and the temperature homogeneity through the bloom cross section.

It is to the amelioration of these drawbacks that the present invention is directed.

SUMMARY OF THE INVENTION

In accordance with the present invention there is provided apparatus for the production of elongated rolled product comprising a continuous casting equipment, a rolling mill positioned downstream of the continuous casting equipment in alignment with the casting line, and a tunnel furnace disposed intermediate the continuous casting equipment and the rolling mill along the line of product. The tunnel furnace has a length of approximately 100 m and it is designed to achieve a soft heating profile for the bar.

It is accordingly an object of the invention to provide a production line which is adapted for the production of elongated product, particularly, in the form of bars in which the yield of the plant is optimized.

It is a further object of the invention to provide a line for the production of elongated bar product in which the size of the plant is minimized, thus to provide production efficiencies.

It is another object of the invention to provide a casting and rolling system in which the following improvements should be achieved:

a. immediate charging into the furnace right after the continuous caster;

b. gradual equalization of the billet temperature;

c. stay time sufficient to guarantee the metallurgical improvement of the product, but not too long to avoid an excessive decarburization.

For a better understanding of the invention, its operating advantages and the specific objectives obtained by its use, reference should be made to the accompanying drawings and description which relate to a preferred embodiment thereof.

DESCRIPTION OF THE PREFERRED EMBODIMENTS OF THE INVENTION

Figure 1:
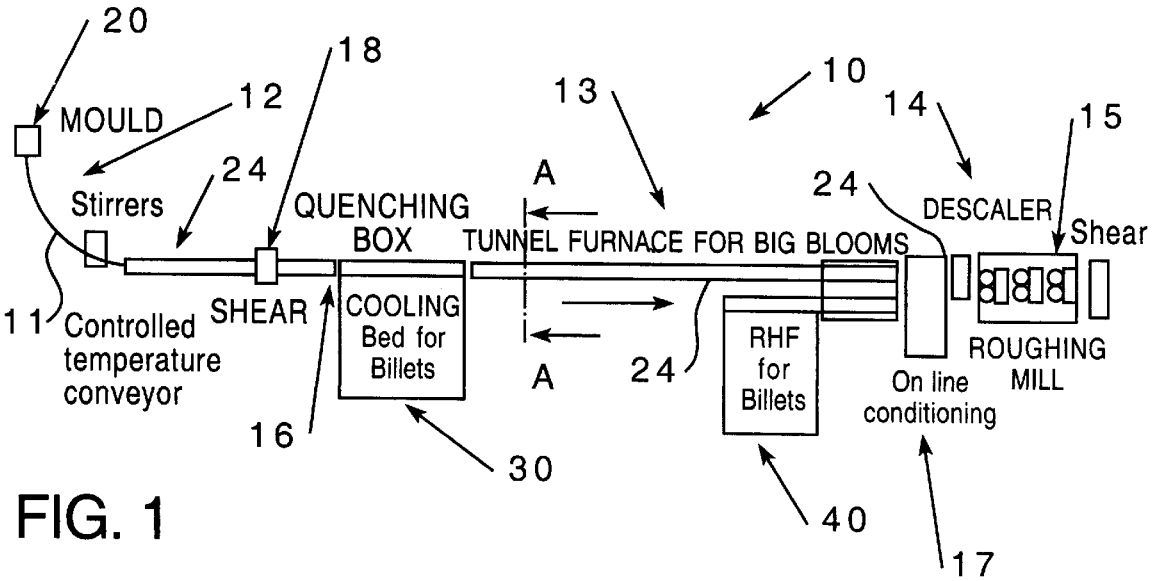
FIG. 1 is a schematic representation illustrating the casting/mill area object of the present invention.
Figure 2:
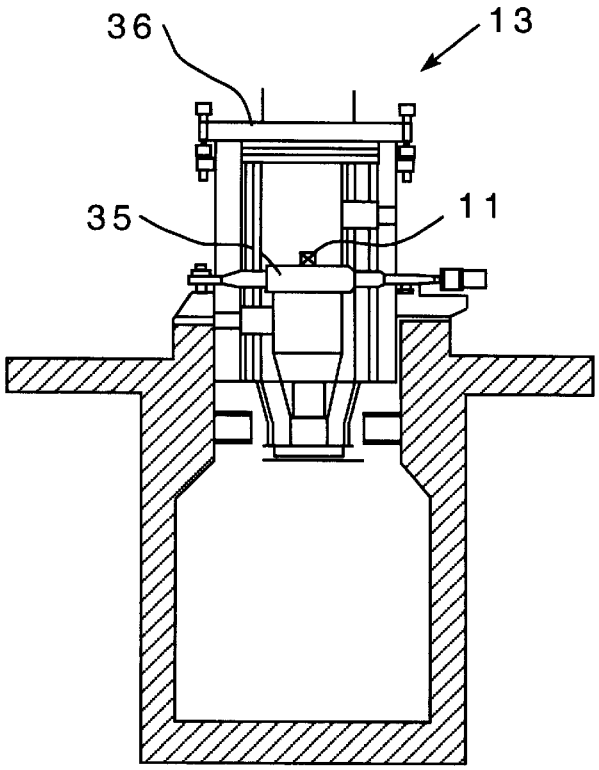
FIG. 2 is a sectional view of the tunnel furnace taken along line A—A of FIG. 1.

The disclosed invention is particularly directed to a plant 10 for the production of bars, wire, rod, rebar, or shaped beams or anoles, and the like, in which the bloom 11 is directly linked from caster 12 to the rolling mill 15 without having to pass through a traditional heating furnace.

The process comprises:

a. casting the product in a one-line high-speed caster 12;

b. heating, equalizing and holding in a tunnel furnace 13;

c. descaling in a descaler 14 and directly rolling in a rolling mill 15.

In FIG. 1 the production line is schematically shown as containing continuous casting equipment 12 including a mold 20 which as is well known, receives molten metal from a tundish (not shown), or the like and delivers a bloom 11 to a conveyor 24, typically a roll conveyor suitable for conveying high temperature metal product.

The illustrated production line contains an in-line shear 18 which may be of the blade or flame-type and that is used to cut the billets during the change of the rolling sequence (bar section) or during emergency events that may occur to the continuous; caster or to the rolling train. Alone the line a quenching box 16, used for those steels which have nitride precipitation problems, is inserted. A tunnel furnace 13, whose principal function it is to heat up and to equalize the temperature of the bloom and to bring it to a rolling temperature prior to its being passed to the rolling mill 15, as hereinafter more fully described, is provided upstream of the roughing mill stand 15.

Advantageously, a descaling assembly 14, as shown in FIG. 1 is disposed in conveyor line 24 intermediate the discharge end of the tunnel furnace 13 and the entrance to the roughing mill stand 15. The descaling assembly 14 may be of any well known type hut preferably is not the water-operated type including( rotary nozzles (not shown) providing a high pressure impact and a low overall rate of water flow so as to reduce to a minimum the loss of temperature from the bloom 11 passing to the rolling mill.

Between the tunnel furnace and mill inlet, in an advantageous position before the descaler and mill, an on-line conditioning device can be provided which enables an efficacious elimination of surface defects before entering the mill. The device may comprise in-line grinding systems or in-line scarfers using a special flame for eliminating the billet surface layer.

The tunnel furnace 13 may be heated by any of a number of available heating sources including free flame burners, radiating pipes, induction heaters, or any combination of these, either with or without a protective atmosphere. In the tunnel furnace 13 the conveying rollers 35 are enclosed within walls 36 having a thermal resistant lining.

The principal aim is to obtain an almost continuous feeding of the rolling mill 15 using an extremely compact and rational layout upstream the mill. In this way, considerable savings can be achieved both in terms of equipment investment and operating costs.

The continuous casting machine 12 must, therefore, be linked in the most direct way with the rolling mill 15. What must be done in the gap between the continuous caster and the rolling mill is the equalization of the billet temperature to that required for the rolling process. This temperature is then maintained for a sufficient time so as to guarantee a quality improvement from the metallurgical point of view, but not too long as to prevent an excessive decarburization of the product inside the furnace.

The present invention allows the immediate charging into the active tunnel furnace 13. In this way it is possible to avoid temperature reduction before the charging into the tunnel furnace 13 and it is not necessary to increase the surface temperature up to a value much higher than that of the core temperature thus avoiding the wait for the equalizing process in ail- as required in the system disclosed in European Application No. EP 0 761 327.

By changing the capacity of the tunnel furnace 13 it is possible to obtain the temperature profiles desired inside the furnace.

In normal functioning conditions there is only one bloom 11 which goes from the caster 12 to the rolling mill train 15. The casting speed therefore must be equal to the minimum allowed rolling speed. This is guaranteed by innovative high-speed casting.

If there are stops in the rolling mill 15, for changing the rolling sequence (bar section) or for various problems, a shear 18 for cutting and the driven roll conveyors 35 for extracting the billets tram the line are provided. In case of a stop of the train 15 for a few minutes to change a rolling sequence, it is possible to cut the bloom by shear 18 and to increase the rolling speed in order to create the desired gap time between the last rolled bloom and the new one coming from continuous caster 12 at fixed speed.

Another possibility is to reduce the casting speed maintaining the rolling speed constant. If the stop time will be higher the bloom is cut to billets 12–14 m longs, that are put onto a cooling bed 30 and then stored.

Moreover, the possibility is maintained to feed the rolling mill 15 in the traditional way, charging the cold billets (12–14 m longs) into the re-heating furnace 40 even during continuous caster and tunnel furnace maintenance. This method unites efficiency with safety and flexibility.

It will be understood that various changes in the details, materials and arrangements of parts, which have been herein described and illustrated in order to explain the nature of the invention, may he made by those skilled in the art within the principle and scope of the invention as expressed in the appended claims.

What is claimed is:

1. Apparatus for the production of elongated rolled bar and rod product comprising:

continuous casting equipment for casting the bar and rod product in the form of a bloom in a one-line high-speed caster;

a roughing rolling mill positioned downstream of said continuous casting equipment in alignment with said one-line high-speed caster;

a controlled temperature conveyor extending between said continuous casting equipment and said roughing rolling mill for conveying said bloom;

an active tunnel furnace disposed intermediate said continuous casting equipment and said roughing rolling mill for the immediate charging of the bloom from the continuous casting equipment for heating, equalizing and holding said bloom to a predetermined rolling temperature;

a descaling assembly included between said active tunnel furnace and said rolling mill.

2. Apparatus according to claim 1, including an on-line conditioning device between said active tunnel furnace and said roughing rolling mill.

3. Apparatus according to claim 1, including a quenching box between said continuous casting equipment and said tunnel furnace.

4. Apparatus according to claim 1, including an in-line shear between the continuous casting equipment and the tunnel furnace which is used to cut the bloom into billets during the change of the rolling sequence or during emergency events.

5. A method for in-line casting and rolling a bloom for bar and rod product comprising the steps of:

continuously casting a bloom for bar and rod product in a one-line high-speed caster;

providing a roughing rolling mill in-line with the high-speed caster;

providing a controlled temperature conveyor extending between said high-speed caster and said roughing rolling mill; and conveying the bloom from the high-speed caster to the rolling mill with said controlled temperature conveyor;

providing an active tunnel furnace between the high-speed caster and the roughing rolling mill and operating said active tunnel furnace to immediately receive the bloom from the high-speed caster and to heat up and equalize the temperature of the bloom at a predetermined rolling temperature;

descaling said bloom intermediate said active tunnel furnace and said roughing rolling mill; and rough rolling the bloom as one continuous length bloom extending from the high-speed caster through the rolling mill, at a rolling entry speed substantially equal to a casting exit speed of the high-speed caster.

6. A method according to claim 5, including the step of on-line conditioning the bloom between said active tunnel furnace and said roughing rolling mill.

7. A method according to claim 5, including the step of providing a quenching box between said high-speed caster and said tunnel furnace.

* * * * *